US007752860B2

(12) United States Patent
Manole

(10) Patent No.: US 7,752,860 B2
(45) Date of Patent: Jul. 13, 2010

(54) METHOD AND APPARATUS FOR IMPROVING EVAPORATOR PERFORMANCE

(75) Inventor: Dan M. Manole, Tecumseh, MI (US)

(73) Assignee: Tecumseh Products Company, Ann Arbor, MI (US)

( * ) Notice: Subject to any disclaimer, the term of this patent is extended or adjusted under 35 U.S.C. 154(b) by 293 days.

(21) Appl. No.: 11/735,765

(22) Filed: Apr. 16, 2007

(65) Prior Publication Data

US 2007/0240433 A1 Oct. 18, 2007

Related U.S. Application Data

(60) Provisional application No. 60/792,846, filed on Apr. 18, 2006.

(51) Int. Cl.
*F25D 23/12* (2006.01)

(52) U.S. Cl. ..... 62/259.4; 62/304; 62/314

(58) Field of Classification Search ..... 62/259.4, 62/304, 305, 314, 91
See application file for complete search history.

(56) References Cited

U.S. PATENT DOCUMENTS 4,380,910 A * 4/1983 Hood et al. ..... 62/91
4,910,971 A * 3/1990 McNab ..... 62/310
6,293,121 B1 9/2001 Labrador
6,571,569 B1 * 6/2003 Rini et al. ..... 62/259.2
6,823,684 B2 11/2004 Jensen
2005/0042716 A1 * 2/2005 Nakajima et al. ..... 435/68.1

* cited by examiner

*Primary Examiner*—Melvin Jones
(74) *Attorney, Agent, or Firm*—Baker & Daniels LLP

(57) ABSTRACT

A method and apparatus for improving the rate of heat transfer between an evaporator of a refrigeration system and the environment surrounding the evaporator. In one embodiment, the evaporator is placed in thermal communication with the air of a data center where electronic equipment is operated therein. To improve the rate of heat transfer between the air and the evaporator, water is evaporated into the air before it flows over the evaporator coils. As a result, when the humidified air flows over the cold evaporator coils, a portion of the water vapor in the air condenses on the evaporator, thereby wetting the evaporator coils. The wetted surfaces of the evaporator coils improve the rate of heat transfer between the air and, ultimately, the refrigerant passing through the evaporator. In one embodiment, a humidifier having a water atomizer may be used for spraying and dispersing water into the air.

6 Claims, 3 Drawing Sheets

METHOD AND APPARATUS FOR IMPROVING EVAPORATOR PERFORMANCE

CROSS-REFERENCE TO RELATED APPLICATION

This application is related to and claims the benefit under 35 U.S.C. §119(e) of U.S. Provisional Patent Application Ser. No. 60/792,846, filed Apr. 18, 2006.

BACKGROUND OF THE INVENTION

1. Field of the Invention

The present invention relates to refrigeration systems. More particularly, the present invention relates to a method and apparatus for improving the thermal transfer between an evaporator of a refrigeration system, or air-conditioning system, and an environment surrounding the evaporator.

2. Description of the Prior Art

Generally, the evaporator of a refrigeration system is typically positioned in a substantially closed environment for the purpose of removing thermal energy, or heat, from the environment. More particularly, the evaporator typically includes a coil, or a plurality of coils, which are configured and arranged to absorb heat from the surrounding environment and conduct the heat into a refrigerant passing through the coils. As is known in the art, the efficiency of the refrigeration system is largely dependent upon the rate and the amount of heat that is transferred from the environment surrounding the evaporator into the refrigerant.

In one embodiment, the substantially enclosed environment includes a room having electronic equipment, for example, operated therein. In operation, this equipment produces heat which, if not removed from the room, may shorten the useful life of the equipment. Accordingly, it is known to circulate the air in the room over the coils of a refrigeration system evaporator to cool the air passing thereover.

The rate of heat transfer into the evaporator coils is largely dependent upon the heat transfer coefficient between the evaporator coils and the air passing over the coils. The heat transfer coefficient is a function of many parameters, including whether the coils of the evaporator are wet from a liquid such as, e.g., water condensate. The heat transfer coefficient is increased, and thus the rate of heat transfer is increased, if the coils of the evaporator are wet. Placing a fluid on the coils of the evaporator will improve the rate of heat transfer between the evaporator and the surrounding air, however, the evaporator will, in part, cool the fluid instead of the air. This may reduce the efficiency of the system, and thus, placing a fluid on the evaporator is typically disincentivized.

SUMMARY OF THE INVENTION

The present invention includes a method and apparatus for improving the rate of heat transfer between an evaporator of a refrigeration system and the environment surrounding the evaporator. In one embodiment, the evaporator is placed in thermal communication with the air of a data center where electronic equipment is operated therein, for example. In other embodiments, the evaporator may be placed in thermal communication with an electronics equipment room, cell phone tower repeater room, or may be used for other applications such as, for example, cooling military electronic equipment used in a hot, dry desert environment. To improve the rate of heat transfer between the air and the evaporator, water is evaporated, or boiled, into the air before it flows over the evaporator coils. As a result, when the humidified air flows over the cold evaporator coils, a portion of the water in the humidified air condenses on the evaporator, thereby wetting the evaporator coils. The wetted surfaces of the evaporator coils improve the rate of heat transfer between the air and, ultimately, the refrigerant passing through the evaporator.

As a result of the above, the evaporator may be operated at a higher temperature owing to the improved rate of heat transfer. Stated in another way, as the rate of heat transfer is improved, the evaporator does not need to be as cold to accomplish the same net heat transfer. Operating an evaporator at a higher temperature may reduce the cost to operate the refrigeration system, as less work is required from the compressor. Alternatively, as a result of the improved heat transfer rate, the size of the evaporator may be reduced, which may result in a less expensive evaporator. In one embodiment, these cost savings may be used to install and operate a humidifier having a water atomizer for spraying and dispersing water into the air, as described above. In one embodiment, the humidifier includes a reservoir, a feed line in fluid communication with the reservoir, and a pump for drawing water through the feed line into the atomizer nozzle where the water is dispersed as a mist.

BRIEF DESCRIPTION OF THE DRAWINGS

The above mentioned and other features and objects of this invention, and the manner of attaining them, will become more apparent and the invention itself will be better understood by reference to the following description of an exemplary embodiment of the invention taken in conjunction with the accompanying drawings, wherein.

Figure 1:
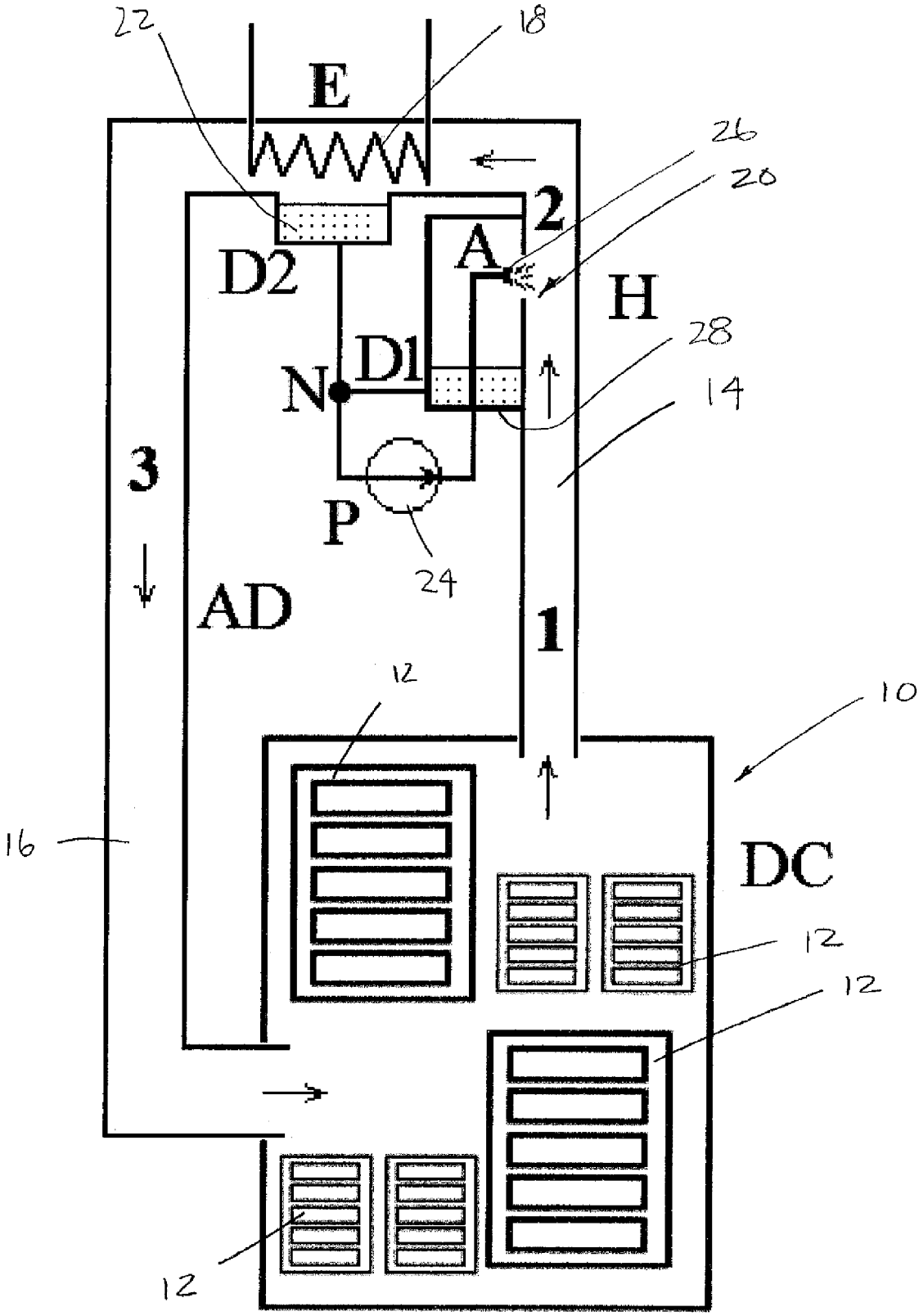
FIG. 1 is a schematic of a humidifier and an evaporator placed in an air duct of a data center in accordance with an embodiment of the present invention.

Corresponding reference characters indicate corresponding parts throughout the several views. Although the drawings represent an embodiment of the present invention, the drawings are not necessarily to scale and certain features may be exaggerated in order to better illustrate and explain the present invention. The exemplification set out herein illustrates an embodiment of the invention, in one form, and such exemplification is not to be construed as limiting the scope of the invention in any manner.

DETAILED DESCRIPTION

The embodiment disclosed below is not intended to be exhaustive or limit the invention to the precise forms disclosed in the following detailed description. Rather, the embodiment is chosen and described so that others skilled in the art may utilize its teachings.

Figure 3:
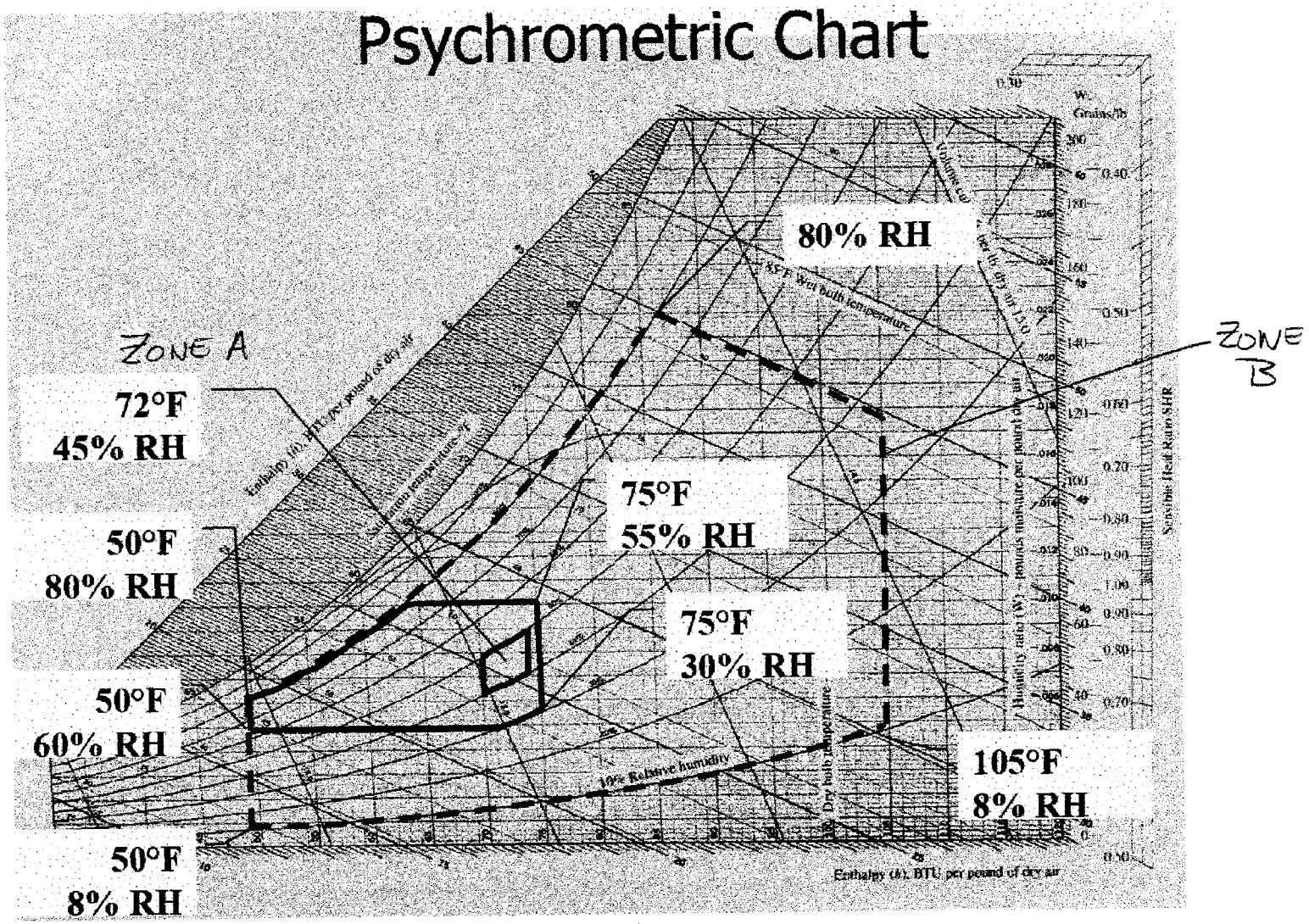
FIG. 3 is a psychometric chart illustrating the ranges of air temperature and humidity typically experienced in a data center.

Referring to the exemplary embodiment of FIG. 1, data center 10, for example, includes electronic equipment 12 operating therein. Electronic equipment, as is known in the art, produces a significant amount of heat when operating. However, the operating life of the electronic equipment can be shortened if the air surrounding the equipment becomes too hot. For example, as a general rule, for every 18° F. increase of air temperature surrounding the equipment, the life of the equipment is reduced by 50%. Accordingly, it is important to circulate and cool the air in the data center such that the temperature of the air surrounding the equipment can be controlled. In particular, referring to FIG. 3, it is often preferable to maintain the temperature of the air surrounding the equipment between 70° F. and 74° F., as represented by zone A, whereas the typical operating limits for the equipment, as specified by the equipment manufacturer, is represented by Zone B. Further, it is also important to control the humidity of the air, as very dry air may allow electrostatic discharge to occur in the electronic equipment which may damage it. For example, referring to Zone A in FIG. 3, the preferred relative humidity surrounding the server is typically between 40% and 50% whereas, referring to Zone B, the limits specified by the equipment manufacturer are typically between 8% and 80%. As a result, there exists a need to control the temperature and humidity of the air in the data center, however, the invention of this application is not limited to a data center, rather, the invention described herein can be used for other applications such as, for example, an electronics equipment room, a cell phone tower repeater room, or for cooling military electronic equipment used in a hot, dry desert environment.

Referring to FIG. 1, the air in data center 10 is circulated through air ducts 14 and 16 by, for example, a fan (not illustrated). While flowing through air duct 14, the air passes over evaporator 18 which absorbs heat from the air. Evaporator 18 is part of a refrigeration system having refrigerant, such as, e.g., carbon dioxide, flowing therein. Owing to the thermodynamic processes of the refrigeration system, as is known in the art, the refrigerant flowing through the evaporator is typically colder than the air flowing over the evaporator. As a result, heat is transferred from the air, through the coils of the evaporator, and into the refrigerant passing through the evaporator. The rate at which the heat transfers from the air to the refrigerant depends on several parameters. These parameters include, for example, the temperature difference between the air and the refrigerant, the geometry and material of the evaporator coils, and whether the surface of the evaporator coils is wet. These parameters, among others, contribute to the thermal transfer coefficient which summarizes, in effect, the rate at which heat will be transferred between the air and the evaporator. Evaporators having low thermal transfer coefficients typically require the compressor to work harder to improve the heat transfer rate between the air and the refrigerant, which, ultimately, results in a lower efficiency of the refrigeration system.

As described above, the rate at which heat is transferred between the air flowing through air duct 14 and the refrigerant passing through evaporator 18 is improved if the coils of the evaporator are wet. In order to utilize this phenomenon, humidifier 20 is placed inside, or in fluid communication with, air duct 14 to evaporate or spray water into the air as it passes through air duct 14. As a result, the amount of water vapor in the air passing through air duct 14 is increased. In operation, the water vapor is carried to evaporator 18 where it condenses on the cold coils of the evaporator. Stated in another way, when the air flows over the cold coils of evaporator 18, the temperature of the air drops until it reaches its dew point temperature. At the dew point temperature, the water vapor in the air will begin to condense on the evaporator. In a further embodiment, the water may be boiled to produce the water vapor in the air.

Notably, the evaporation of water is an endothermic process and, when the water is evaporated into the air in air duct 14, energy is absorbed from the air. In effect, the evaporation of the water converts the sensible heat, i.e., the heat energy stored in the air, into latent heat, i.e., the energy required to change the phase of the water. However, the total heat, i.e., the sensible heat plus the latent heat, remains substantially unchanged. Stated in another way, when the same amount of water is condensed on the evaporator that is evaporated by humidifier 20, the latent heat absorbed by the evaporator during the condensation of the water vapor is, in effect, the sensible heat absorbed from the air by the water vapor when the water is evaporated. If less water is condensed on evaporator 18 than is evaporated by humidifier 20, the evaporation of the water will have a net cooling effect. Stated in another way, in this circumstance, the amount of sensible heat absorbed from the air during evaporation will be greater than the latent heat absorbed by the evaporator during condensation and, as a result, the temperature of the air will be lower.

Figure 2:
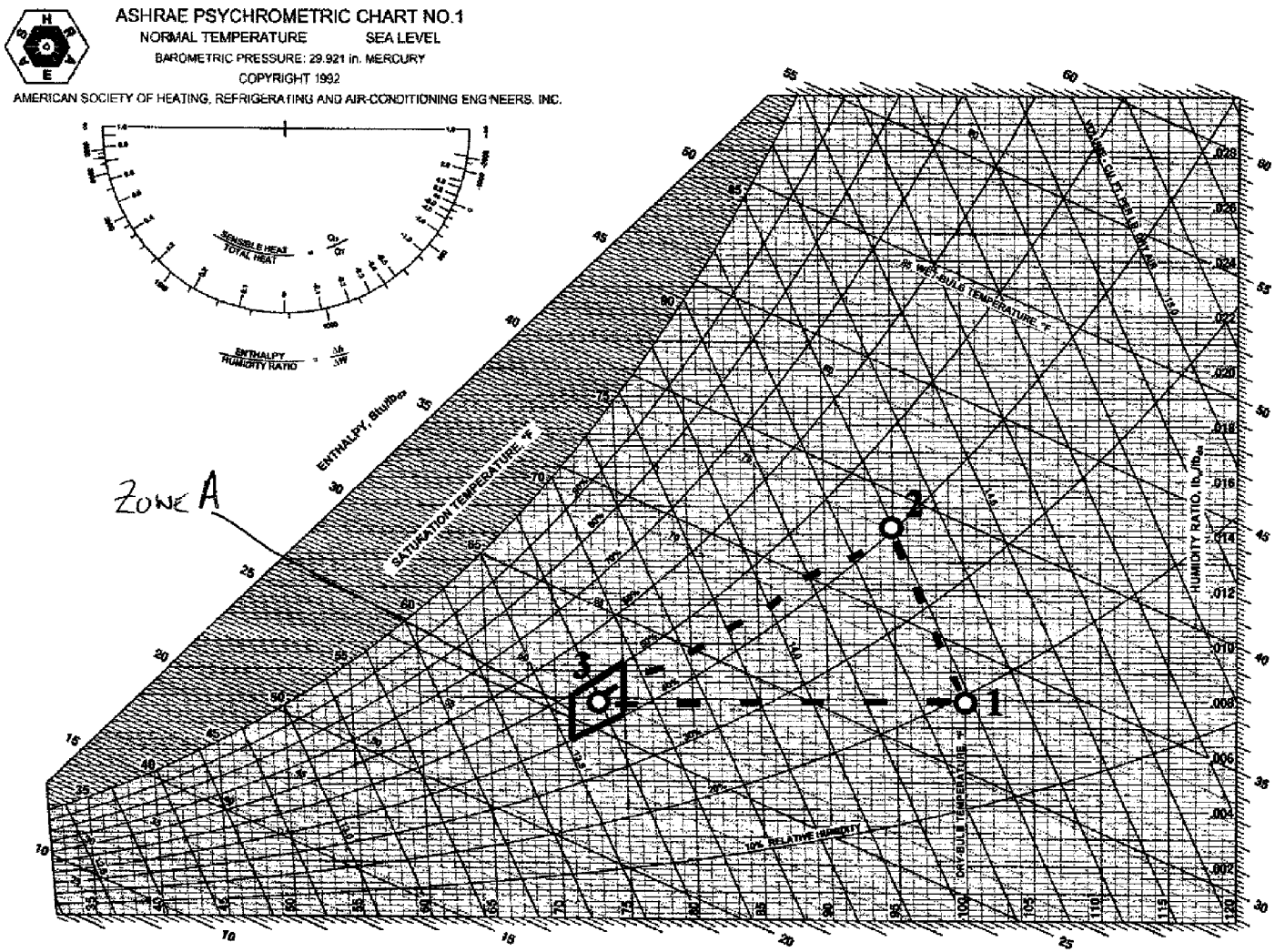
FIG. 2 is a psychometric chart illustrating the thermodynamic cycle of air circulated through the data center of FIG. 1.

Referring to the psychometric chart of FIG. 2, the air in the data center passes through, essentially, three primary thermodynamic points as it is circulated through the aforementioned air conditioning system. Point 1 represents the temperature and relative humidity of the air as it enters into air duct 14 from data center 10. In this embodiment, the temperature of the air is approximately 100° F. with approximately 20% relative humidity. As discussed above, water is then evaporated into the air as it flows past humidifier 20 in air duct 14. This endothermic process cools and humidifies the air to a thermodynamic state represented by point 2. More particularly, in this embodiment, the temperature of the air at point 2 is approximately 95° F. with approximately 40% relative humidity. Thereafter, the air flows over evaporator 18 where it is cooled to the thermodynamic state represented by point 3. In this embodiment, the temperature of the air in state 3 is approximately 73° F., however, the relative humidity has increased to approximately 45%. Although this increase in relative humidity may seem counterintuitive, as water has just precipitated from the air onto the evaporator, the increase in relative humidity is a result of the drop in the relative capacity of the cooled air to hold evaporated water.

Notably, in the present embodiment, referring to FIG. 2, the dew point temperature of the air in state 3 is approximately 67° F. while the temperature of the air in state 3 is approximately 73° F. As discussed above, the evaporated water in the air will not substantially condense onto the evaporator unless the temperature of the air has been lowered to its dew point temperature. However, those skilled in psychometrics will understand that although the bulk temperature of the air is approximately 73° F., the boundary layer of air proximate the cold coils of the evaporator will be at the dew point temperature, thus allowing the water vapor in the air to condense on the evaporator coils. The cooled air then flows through air duct 16 into data center 10. Notably, the condition of the air at point 3 is within Zone A, i.e., the preferable ranges of temperature and relative humidity to cool the electronic equipment in data center 10, as discussed above.

As discussed above, humidifier 20 can be used to evaporate water into the air passing through air duct 14. Referring to FIG. 1, humidifier 20 includes drain 22 positioned under evaporator 18. In operation, as water is condensed onto the coils of evaporator 18, the water may drip or flow downwardly, owing to gravity, from the evaporator. Drain 22 is positioned to catch the dripping water so that it may be used by humidifier 20 to humidify the air. To this end, humidifier 20 further includes pump 24, which is in fluid communication with drain 22, to draw the water in drain 22 into atomizer 26. In use, atomizer 26 sprays or aerosolizes very small water droplets into the air flowing through air duct 14. To collect the particles of water which may immediately precipitate from the air, humidifier 20 further includes drain 28 positioned underneath atomizer 26. Drain 28 is also in fluid communication with pump 24 so that the water in drain 28 may be recirculated back to atomizer 26.

In the circumstance where more water is evaporated by humidifier 20 than is condensed on evaporator 18, the excess evaporated water will increase the relative humidity of the air flowing into data center 10. Alternatively, the amount of evaporated water can be reduced such that the evaporator is condensing more water than is being evaporated by humidifier 20 to reduce the relative humidity of the air. Advantageously, as a result, the relative humidity of the air in data center 10 can be controlled by controlling the amount of water evaporated by humidifier 20. In an alternative embodiment, several humidifiers 20 may be used which can be positioned and operated as needed to accomplish the goals and aims of the present invention. In one embodiment, at least one humidifier 20 is positioned downstream of evaporator 18, i.e., in air duct 16, for example, to control the humidity, and temperature, of the air entering into data center 10. The relative humidity of the air, along with the air temperature, can be monitored and controlled by a system of sensors and computers which can activate and deactivate humidifier 20, for example, to control the amount of water evaporated into the air. Further, the rate and/or amount of water ejected by atomizer 26 can be controlled by a valve or a variable speed pump.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A system for reducing the temperature of air, comprising:

a refrigeration system including an evaporator;

a fan for moving the air in an air stream; and a humidifier positioned upstream of the evaporator for introducing water into the air stream before the air stream passes over the evaporator, the humidifier including an atomizer means for aerosolizing the water in the air, whereby the aerosolized water evaporates into the air stream, is carried by the air stream to said evaporator, and condenses on said evaporator to improve the rate of heat transfer between the air and the evaporator.

2. A system for reducing the temperature of air, comprising:

a refrigeration system including an evaporator;

a fan for moving the air; and a humidifier positioned upstream of the evaporator for introducing water into the air before the air stream passes over the evaporator, the humidifier including an atomizer for aerosolizing the water in the air, whereby the aerosolized water evaporates into the air, is carried by the air to said evaporator, and condenses on said evaporator to improve the rate of heat transfer between the air and the evaporator;

wherein said humidifier further comprises:

a drain proximate said evaporator for collecting condensed water on said evaporator; and a pump for pumping the water to the atomizer.

3. A method of lowering the temperature of air passing over an evaporator, comprising the steps of:

at a position upstream of the evaporator, aerosolizing water by means of an atomizer into a flowing air stream so that the water evaporates and forms a mist in the air stream;

then conveying the air stream containing the mist to the evaporator and flowing the mist and air stream over the evaporator; and condensing at least some of the aerosolized water on the evaporator, thereby improving the rate of heat transfer between the air and the evaporator.

4. A method of lowering the temperature of air passing over an evaporator, comprising the steps of:

aerosolizing water into a mist in a flowing air stream so that the water evaporates;

flowing the aerosolized water and air over an evaporator;

condensing at least some of the aerosolized water on the evaporator, thereby improving the rate of heat transfer between the air and the evaporator; and collecting condensed water from the evaporator and conveying such condensed water to an aerosolizer for re-evaporation into the air stream upstream of the evaporator.

5. A method of cooling an enclosure containing electronic equipment, comprising:

directing air from the enclosure and aerosolizing water into a mist into the air downstream of the enclosure and upstream of an evaporator thereby causing the water to evaporate in the air;

then flowing the aerosolized water and air over the evaporator;

condensing at least some of the aerosolized water on the evaporator thereby improving the rate of heat transfer between the air and the evaporator; and flowing the air from the evaporator into the enclosure.

6. A method of cooling an enclosure containing electronic equipment, comprising:

directing air from the enclosure and aerosolizing water into a mist into the air downstream of the enclosure thereby causing the water to evaporate;

flowing the aerosolized water and air over an evaporator;

condensing at least some of the aerosolized water on the evaporator thereby improving the rate of heat transfer between the air and the evaporator;

flowing the air from the evaporator into the enclosure; and collecting condensed water from the evaporator and conveying such condensed water to an aerosolizer for re-evaporation into the air stream upstream of the evaporator.

* * * * *